US012072111B2

(12) United States Patent
Miyake et al.

(10) Patent No.: US 12,072,111 B2
(45) Date of Patent: Aug. 27, 2024

(54) AIR CONDITIONING CAPACITY PRESENTING SYSTEM

(71) Applicant: DAIKIN INDUSTRIES, LTD., Osaka (JP)

(72) Inventors: Yuka Miyake, Osaka (JP); Tadafumi Nishimura, Osaka (JP); Koji Nagasawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 352 days.

(21) Appl. No.: 17/441,634

(22) PCT Filed: Mar. 30, 2020

(86) PCT No.: PCT/JP2020/014698
§ 371 (c)(1),
(2) Date: Sep. 21, 2021

(87) PCT Pub. No.: WO2020/196925
PCT Pub. Date: Oct. 1, 2020

(65) Prior Publication Data

US 2022/0146133 A1 May 12, 2022

(30) Foreign Application Priority Data

Mar. 28, 2019 (JP) ..... 2019-063098

(51) Int. Cl.
*F24F 11/46* (2018.01)
*F24F 11/50* (2018.01)
(Continued)

(52) U.S. Cl.
CPC ..... *F24F 11/46* (2018.01); *F24F 11/50* (2018.01); *F24F 11/64* (2018.01);
(Continued)

(58) Field of Classification Search
CPC .. F24F 11/46; F24F 11/50; F24F 11/64; F24F 2110/12; F24F 2140/50; F24F 11/30; F24F 2110/22; F24F 11/62
See application file for complete search history.

(56) References Cited

U.S. PATENT DOCUMENTS 10,871,756 B2 † 12/2020 Johnson
2018/0137227 A1* 5/2018 Ishii ..... G06F 30/367
(Continued)

FOREIGN PATENT DOCUMENTS

EP 3 026 359 A1 6/2016
EP 3 034 966 A1 6/2016
(Continued)

OTHER PUBLICATIONS

European Search Report of corresponding EP Application No. 20 779 988.3 dated Apr. 4, 2022.
(Continued)

*Primary Examiner* — Kun Kai Ma
(74) *Attorney, Agent, or Firm* — Global IP Counselors, LLP

(57) ABSTRACT

An air conditioning capacity presenting system presents a capacity of an air conditioning apparatus including at least one outdoor unit, at least one indoor unit, and a connection pipe that connects the outdoor unit and the indoor unit. The air conditioning capacity presenting system includes first acquisition unit, a measurement unit, a second acquisition unit, and a capacity calculating unit. The first acquisition unit acquires outdoor unit capacity information, which is a rated capacity of the outdoor unit or information related to the rated capacity. The measurement unit measures power consumption of the outdoor unit. The second acquisition unit acquires an outside air temperature, which is a temperature of air around the outdoor unit. The capacity calculating unit obtains a calculation value of the capacity of the air condi-
(Continued)

tioning apparatus based on the outdoor unit capacity information, the power consumption, and the outside air temperature.

20 Claims, 8 Drawing Sheets

(51) Int. Cl.
*F24F 11/64* (2018.01)
*F24F 110/12* (2018.01)
*F24F 140/50* (2018.01)
*F24F 140/60* (2018.01)

(52) U.S. Cl.
CPC ..... *F24F 2110/12* (2018.01); *F24F 2140/50* (2018.01); *F24F 2140/60* (2018.01)

(56) References Cited

U.S. PATENT DOCUMENTS

| | | | | |
|---|---|---|---|---|
| 2020/0080742 | A1 | 3/2020 | Okamoto et al. | |
| 2022/0349603 | A1 * | 11/2022 | Motodani | F24F 11/89 |

FOREIGN PATENT DOCUMENTS

| | | | | | |
|---|---|---|---|---|---|
| GB | 2 289 124 | A | | 11/1995 | |
| JP | 2004301505 | A | * | 10/2004 | |
| JP | 2010-38487 | A | | 2/2010 | |
| JP | 2010-96432 | A | | 4/2010 | |
| JP | 2012-255570 | A | | 12/2012 | |
| JP | 2013134019 | A | * | 7/2013 | |
| JP | 2013-221676 | A | | 10/2013 | |
| JP | 2018146229 | A | * | 9/2018 | |
| JP | 6414354 | B1 | * | 10/2018 | F24F 1/32 |
| WO | 2018/182022 | A1 | | 10/2018 | |

OTHER PUBLICATIONS

International Preliminary Report of corresponding PCT Application No. PCT/JP2020/014698 dated Oct. 7, 2021.
International Search Report of corresponding PCT Application No. PCT/JP2020/014698 dated Jun. 30, 2020.
European Search Report of corresponding EP Application No. 23 17 8013.1 dated Aug. 28, 2023.
Author: David Johnson Jr. Title of the publication: website, specifically most relevant would be the How it works page and the video on the Documents page, wherein I believe that I said something like that historical electrical load and historical operational load might arguably be the same thing, arguably being a key word, needing qualification. I am not using that reference because I do not want to submit over 3 references to examiner, but it is worth mentioning that I suggest that examiner consider the CoolingLogic technologies using all available information, exactly as Daikin would be expected to have done when we sent them a package and offered to sell the IP to them, as we did. Publication date: on or about: Oct. 24, 2016 Place of publication: www.CoolingLogic.com Pages being submitted: 4 Evidence of publication could probably be found via the waybackmachine.†
Title: CoolingLogic A Method to Increase HVAC System Efficiency and Decrease Energy Consumption Author: David L. Johnson Jr. Published online on or about: Sep. 24, 2016 Available online at: http://coolinglogic.com/documents/16102106_White_Paper_High_Resolution_Protected.pdf Printed copy delivered to Daikin on Dec. 27, 2016.†

* cited by examiner
† cited by third party

63

| POWER SENSOR IDENTIFICATION INFORMATION | SYSTEM NAME | MODEL NAME |
|---|---|---|
| WM1FW | OFFICE 1F EAST | ABCD280E |
| WM2FE | OFFICE 2F WEST | ABCD224F |
| WM3FX | | |

FIG. 5

AIR CONDITIONING CAPACITY PRESENTING SYSTEM

CROSS-REFERENCE TO RELATED APPLICATIONS

This U.S. National stage application claims priority under 35 U.S.C. § 119(a) to Japanese Patent Application No. 2019-063098, filed in Japan on Mar. 28, 2019, the entire contents of which are hereby incorporated herein by reference.

BACKGROUND

Field of the Invention

An air conditioning capacity presenting system that presents the capacity of an air conditioning apparatus.

Background Information

An air conditioning capacity measuring system disclosed in (Japanese Patent Application Laid-Open Publication No. 2010-038487 measures the capacity of an air conditioning apparatus. This air conditioning capacity measuring system includes a first thermohygrometer that measures the state of sucked air of an outdoor unit, a second thermohygrometer that measures the state of blown-out air of the outdoor unit, a rotation sensor that measures the number of rotations of a fan of the outdoor unit, a first power meter that measures power consumption of the outdoor unit, and a second power meter that measures power to be supplied to an indoor unit.

SUMMARY

Installing a large number of sensors for measuring the capacity of the air conditioning apparatus in the air conditioning apparatus to be used by a user forces inconvenience upon the user. That is, necessary labor by an operator to measure the capacity are increased. Furthermore, since the large number of sensors are included in the system for measuring the capacity, the cost of the system for measuring the capacity is high.

An air conditioning capacity presenting system according to a first aspect presents a capacity of an air conditioning apparatus including at least one outdoor unit, at least one indoor unit, and a connection pipe that connects the outdoor unit and the indoor unit. The air conditioning capacity presenting system includes a first acquisition unit, a measurement unit, a second acquisition unit, and a capacity calculating unit. The first acquisition unit acquires outdoor unit capacity information, which is a rated capacity of the outdoor unit or information related to the rated capacity. The measurement unit measures power consumption of the outdoor unit. The second acquisition unit acquires an outside air temperature, which is a temperature of air around the outdoor unit. The capacity calculating unit obtains a calculation value of the capacity of the air conditioning apparatus based on the outdoor unit capacity information, the power consumption, and the outside air temperature.

According to this configuration, the calculation value of the air conditioning capacity can be obtained based on the outdoor unit capacity information, the power consumption, and the outside air temperature. Thus, the calculation of the capacity does not need many types of data to be acquired.

An air conditioning capacity outputting system according to a modification of the first aspect outputs a capacity of an air conditioning apparatus including at least one outdoor unit, at least one indoor unit, and a connection pipe that connects the outdoor unit and the indoor unit. The air conditioning capacity outputting system includes a first acquisition unit, a measurement unit, a second acquisition unit, a capacity calculating unit, and an output unit. The first acquisition unit acquires outdoor unit capacity information, which is a rated capacity of the outdoor unit or information related to the rated capacity. The measurement unit measures power consumption of the outdoor unit. The second acquisition unit acquires an outside air temperature, which is a temperature of air around the outdoor unit. The capacity calculating unit obtains a calculation value of the capacity of the air conditioning apparatus based on the outdoor unit capacity information, the power consumption, and the outside air temperature. The output unit outputs the calculated capacity.

An air conditioning capacity presenting system according to a second aspect is the air conditioning capacity presenting system according to the first aspect, in which the capacity calculating unit includes a plurality of capacity calculation models. The capacity calculating unit selects one capacity calculation model from among the plurality of capacity calculation models based on the outdoor unit capacity information.

According to this configuration, the capacity calculating unit selects one capacity calculation model based on the outdoor unit capacity information. Thus, a capacity calculation model appropriate for simulating the capacity of the outdoor unit is used.

An air conditioning capacity outputting system according to a modification of the second aspect is the air conditioning capacity outputting system according to the modification of the first aspect, in which the capacity calculating unit includes a plurality of capacity calculation models. The capacity calculating unit selects one capacity calculation model from among the plurality of capacity calculation models based on the outdoor unit capacity information. The selected capacity calculation model calculates the capacity.

An air conditioning capacity presenting system according to a third aspect is the air conditioning capacity presenting system according to the second aspect, in which each of the capacity calculation models includes an air conditioner performance parameter indicating performance of the air conditioning apparatus. Each of the capacity calculation models is configured to derive an evaporation pressure Pe or a corresponding temperature corresponding thereto or a condensation pressure Pc or a corresponding temperature corresponding thereto in a refrigeration cycle based on the air conditioner performance parameter, the power consumption, and the outside air temperature and to calculate the calculation value based on the derived refrigeration cycle. At least one of the evaporation pressure of refrigerant or the corresponding temperature corresponding thereto and the condensation pressure of refrigerant or the corresponding temperature corresponding thereto in the refrigeration cycle is determined as a constant.

An air conditioning capacity presenting system according to a fourth aspect is the air conditioning capacity presenting system according to second aspect, in which each of the capacity calculation models includes a characteristic formula that expresses a relationship between the power consumption and the capacity.

An air conditioning capacity presenting system according to a fifth aspect is the air conditioning capacity presenting system according to any one of the second to fourth aspects, in which the plurality of capacity calculation models include a plurality of cooling capacity calculation models and a plurality of heating capacity calculation models.

An air conditioning capacity outputting system according to a modification of the fifth aspect is the air conditioning capacity outputting system according to the modification of the second aspect, in which the plurality of capacity calculation models include a plurality of cooling capacity calculation models and a plurality of heating capacity calculation models. In a case of calculating a cooling capacity, one model from among the plurality of cooling capacity calculation models is selected. In a case of calculating a heating capacity, one model from among the plurality of heating capacity calculation models is selected.

An air conditioning capacity presenting system according to a sixth aspect is the air conditioning capacity presenting system according to any one of the first to fifth aspects, further including a correction unit. The correction unit corrects the calculation value to obtain a corrected calculation value.

According to this configuration, the correction unit corrects the calculation value to obtain a corrected calculation value. This increases the accuracy of the necessary capacity.

An air conditioning capacity presenting system according to a seventh aspect is the air conditioning capacity presenting system according to the sixth aspect, in which the correction unit corrects the calculation value based on information related to a pressure loss of refrigerant in the connection pipe.

An air conditioning capacity presenting system according to an eighth aspect is the air conditioning capacity presenting system according to the sixth or seventh aspect, in which the outdoor unit includes an outdoor fan. The correction unit corrects the calculation value based on information related to a rated output of the outdoor fan.

An air conditioning capacity presenting system according to a ninth aspect is the air conditioning capacity presenting system according to any one of the first to eighth aspects, in which the second acquisition unit further acquires an outside air humidity, which is a humidity of the air around the outdoor unit. The capacity calculating unit obtains the calculation value of the capacity of the air conditioning apparatus based on the outdoor unit capacity information, the power consumption, the outside air temperature, and the outside air humidity.

According to this configuration, the outside air humidity is also used in addition to the other parameters to obtain the calculation value of the capacity. Thus, the calculation value with higher accuracy is obtained.

An air conditioning capacity presenting system according to a tenth aspect is the air conditioning capacity presenting system according to any one of the first to ninth aspects, in which the second acquisition unit does not perform measurement related to blown-out air discharged from the outdoor unit after heat exchange.

An air conditioning capacity presenting system according to an eleventh aspect is the air conditioning capacity presenting system according to the sixth aspect, further including a proposal creating unit. The proposal creating unit creates a proposal of a unit-to-be-newly-introduced that is to replace at least part of the outdoor unit and the indoor unit based on a maximum value of the calculation value or the corrected calculation value within a predetermined period.

An air conditioning capacity presenting system according to a twelfth aspect is the air conditioning capacity presenting system according to the eleventh aspect, in which the air conditioning apparatus includes plurality of systems. Each of the plurality of systems includes at least one outdoor unit. The measurement unit measures the power consumption of each of the plurality of systems.

An air conditioning capacity presenting system according to a thirteenth aspect is the air conditioning capacity presenting system according to the twelfth aspect, further including an operation terminal. The measurement unit includes a plurality of power sensors that measure the power consumption of the plurality of systems, respectively. The operation terminal displays pieces of identification information of the power sensors. The operation terminal accepts input of association between the pieces of identification information and the systems.

An air conditioning capacity presenting system according to a fourteenth aspect is the air conditioning capacity presenting system according to the twelfth or thirteenth aspect, in which the proposal creating unit creates the proposal of the unit-to-be-newly-introduced that is to replace at least part of the outdoor unit and the indoor unit for each of the plurality of systems.

A method according to a fifteenth aspect is a method of measuring a capacity of an air conditioning apparatus including at least one outdoor unit and at least one indoor unit. A first acquisition unit acquires outdoor unit capacity information, which is a rated capacity of the outdoor unit or information related to the rated capacity. A measurement unit measures power consumption of the outdoor unit. A second acquisition unit acquires an outside air temperature, which is a temperature of air around the outdoor unit. A capacity calculating unit outputs a calculation value of the capacity of the air conditioning apparatus based on the outdoor unit capacity information, the power consumption, and the outside air temperature.

BRIEF DESCRIPTION OF THE DRAWINGS

FIG. 5 is a screen of an operation terminal 63 in a process of associating pieces of identification information of power sensors 61A to 61C and systems.

DETAILED DESCRIPTION OF EMBODIMENT(S)

First Embodiment (1) Overall Configuration

Figure 1:
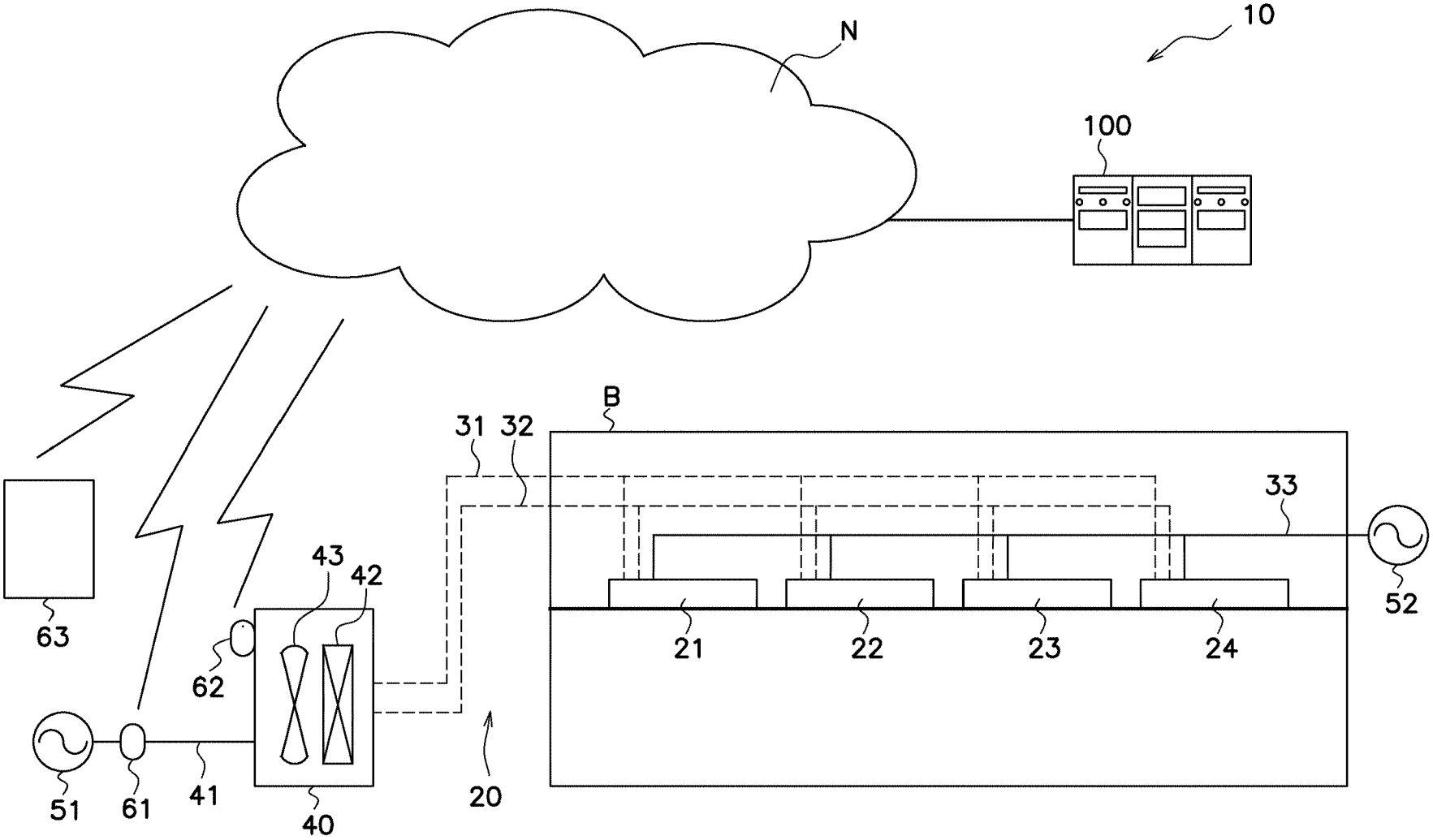
FIG. 1 schematically illustrates an air conditioning capacity presenting system 10 according to a first embodiment.

FIG. 1 illustrates an overall configuration of an air conditioning capacity presenting system 10. The air conditioning capacity presenting system 10 includes an air conditioning apparatus 20, a power sensor 61, a temperature sensor 62, an operation terminal 63, a network N, and a server 100.

(2) Detailed Configuration (2-1) Air Conditioning Apparatus 20

The air conditioning apparatus 20 is a multi-type air conditioning apparatus including a plurality of indoor units 21 to 24.

The air conditioning apparatus 20 includes the indoor units 21 to 24, an outdoor unit 40, and connection pipes 31 and 32.

(2-1-1) Indoor Units 21 to 24

The indoor units 21 to 24 are installed inside a building B. The indoor units 21 to 24 adjust the temperature of environment where a user is present by providing cooled air or heated air to the user. An indoor unit power source line 33 is connected to the indoor units 21 to 24. The indoor unit power source line 33 transmits power from a commercial power source 52 to the indoor units 21 to 24.

(2-1-2) Outdoor Unit 40

The outdoor unit 40 is installed outside the building B. The outdoor unit 40 acquires cold or heat from outside air, which is a heat source. The outdoor unit 40 includes an outdoor unit power source line 41. The outdoor unit power source line 41 transmits power from a commercial power source 51 to the outdoor unit 40. The outdoor unit 40 includes an outdoor heat exchanger 42 and an outdoor fan 43.

(2-1-3) Connection Pipes 31 and 32

The connection pipes 31 and 32 allow refrigerant to move between the indoor units 21 to 24 and the outdoor unit 40. The connection pipes 31 and 32 form refrigerant circuits together with the indoor units 21 to 24 and the outdoor unit 40.

(2-2) Power Sensor 61

The power sensor 61 acquires a measurement value of power consumption of the outdoor unit 40 of the air conditioning apparatus 20. The power sensor 61 is attached to the outdoor unit power source line 41. The power sensor 61 can be connected to the network N by wireless communication and can transmit power consumption data.

(2-3) Temperature Sensor 62

The temperature sensor 62 acquires a measurement value of the outside air temperature. For example, the temperature sensor 62 is attached near the outdoor unit 40. In this case, the outside air temperature is the temperature of air around the outdoor unit 40. The temperature sensor 62 can be connected to the network N by wireless communication and can transmit outside air temperature data.

Note that the temperature sensor 62 does not measure blow-out air discharged from the outdoor unit 40 after heat exchange in the outdoor heat exchanger 42.

(2-4) Operation Terminal 63

The operation terminal 63 is operated by an operator of the air conditioning apparatus 20 or the like. The operator inputs outdoor unit capacity information to the operation terminal 63. The outdoor unit capacity information is, for example, a rated capacity of the outdoor unit 40. Alternatively, the outdoor unit capacity information may be information other than the rated capacity of the outdoor unit 40 and that relates to the rated capacity. The operation terminal 63 can be connected to the network N by wireless communication and can transmit the outdoor unit capacity information.

In addition, the operator inputs, to the operation terminal 63, information related to a pressure loss of refrigerant in the connection pipes 31 and 32. The information related to a pressure loss is, for example, the following amounts.

The length of the connection pipes 31 and 32 connect the indoor unit 24 farthest from the outdoor unit 40 and the outdoor unit 40.

The difference of altitude between the outdoor unit 40 and the indoor units 21 to 24.

The operation terminal 63 can transmit the information related to a pressure loss via the network N.

In addition, the operator inputs, to the operation terminal 63, information related to a rated output of the outdoor fan 43. The operation terminal 63 can transmit the information related to a rated output of the outdoor fan 43 via the network N.

(2-5) Network N

The network N is constituted as an aggregate of a PSTN (public switched telephone network), a mobile phone communication network, a wireless LAN, and other known networks.

(2-6) Server 100

The server 100 is connected to the network N. The server 100 can receive information transmitted from the power sensor 61, the temperature sensor 62, and the operation terminal 63.

(3) Calculation Unit 70

Figure 2:
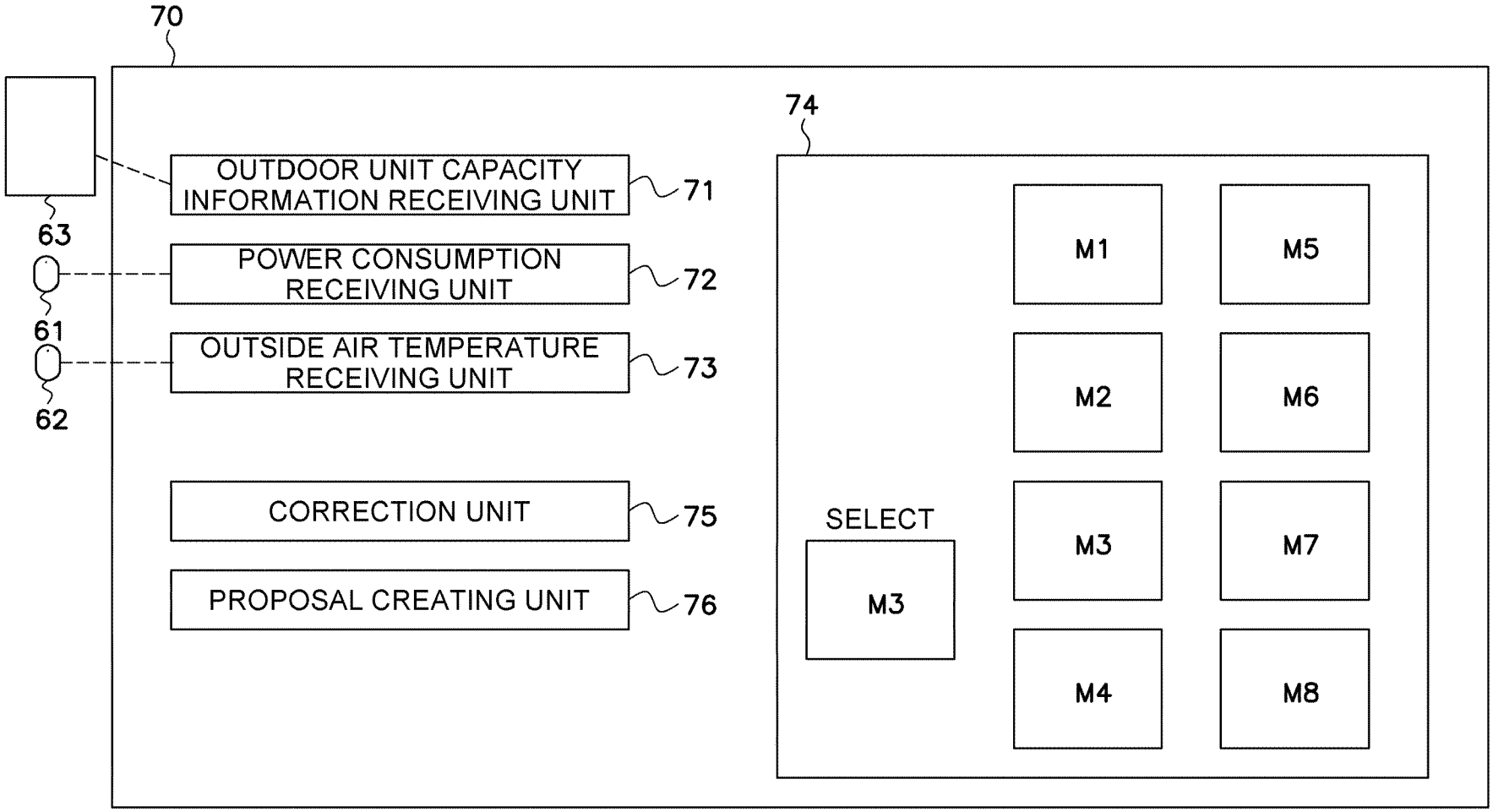
FIG. 2 schematically illustrates a calculation unit 70.

FIG. 2 schematically illustrates a calculation unit 70 that carries out calculation of the air conditioning capacity presenting system 10. The calculation unit 70 is physically included in the server 100. The calculation unit 70 includes an outdoor unit capacity information receiving unit 71, a power consumption receiving unit 72, an outside air temperature receiving unit 73, a capacity calculating unit 74, a correction unit 75, and a proposal creating unit 76. That is, by executing dedicated software, the server 100 functions as the outdoor unit capacity information receiving unit 71, the power consumption receiving unit 72, the outside air temperature receiving unit 73, the capacity calculating unit 74, the correction unit 75, and the proposal creating unit 76.

The outdoor unit capacity information receiving unit 71 receives the outdoor unit capacity information from the operation terminal 63 via the network N.

The power consumption receiving unit 72 receives the power consumption data from the power sensor 61 via the network N.

The outside air temperature receiving unit 73 receives the outside air temperature data from the temperature sensor 62 via the network N.

The capacity calculating unit 74 obtains a calculation value of the capacity of the air conditioning apparatus 20 based on the outdoor unit capacity information, the power consumption, and the outside air temperature.

The capacity calculating unit 74 includes a plurality of capacity calculation models M1 to M8. From among the plurality of capacity calculation models M1 to M8, the capacity calculating unit 74 selects one capacity calculation model based on the outdoor unit capacity information. The plurality of capacity calculation models M1 to M8 include a plurality of cooling capacity calculation models M1 to M4 and a plurality of heating capacity calculation models M5 to M8.

The capacity calculation models M1 to M8 are, for example, characteristic formulas. Instead of this, the capacity calculation models M1 to M8 may also be tables, learned models, or others.

The correction unit 75 corrects the calculation value calculated by the capacity calculating unit 74 to obtain a corrected calculation value. From the network N, the correction unit 75 receives "information related to a pressure loss of refrigerant in the connection pipes 31 and 32" and "information related to a rated output of the outdoor fan 43".

The correction unit 75 uses these pieces of information when obtaining the corrected calculation value from the calculation value.

On the basis of the maximum value of the calculation value or the corrected calculation value within a predetermined period, the proposal creating unit 76 creates a proposal of a unit-to-be-newly-introduced that is to replace at least part of the outdoor unit 40 and the indoor units 21 to 24.

(4) Detailed Configuration of Capacity Calculating Unit 74

The capacity calculating unit 74 can have various configurations. Examples of possible configurations will be described below.

(4-1) Configuration Example 1

(4-1-1) Detailed Configuration

Figure 6:
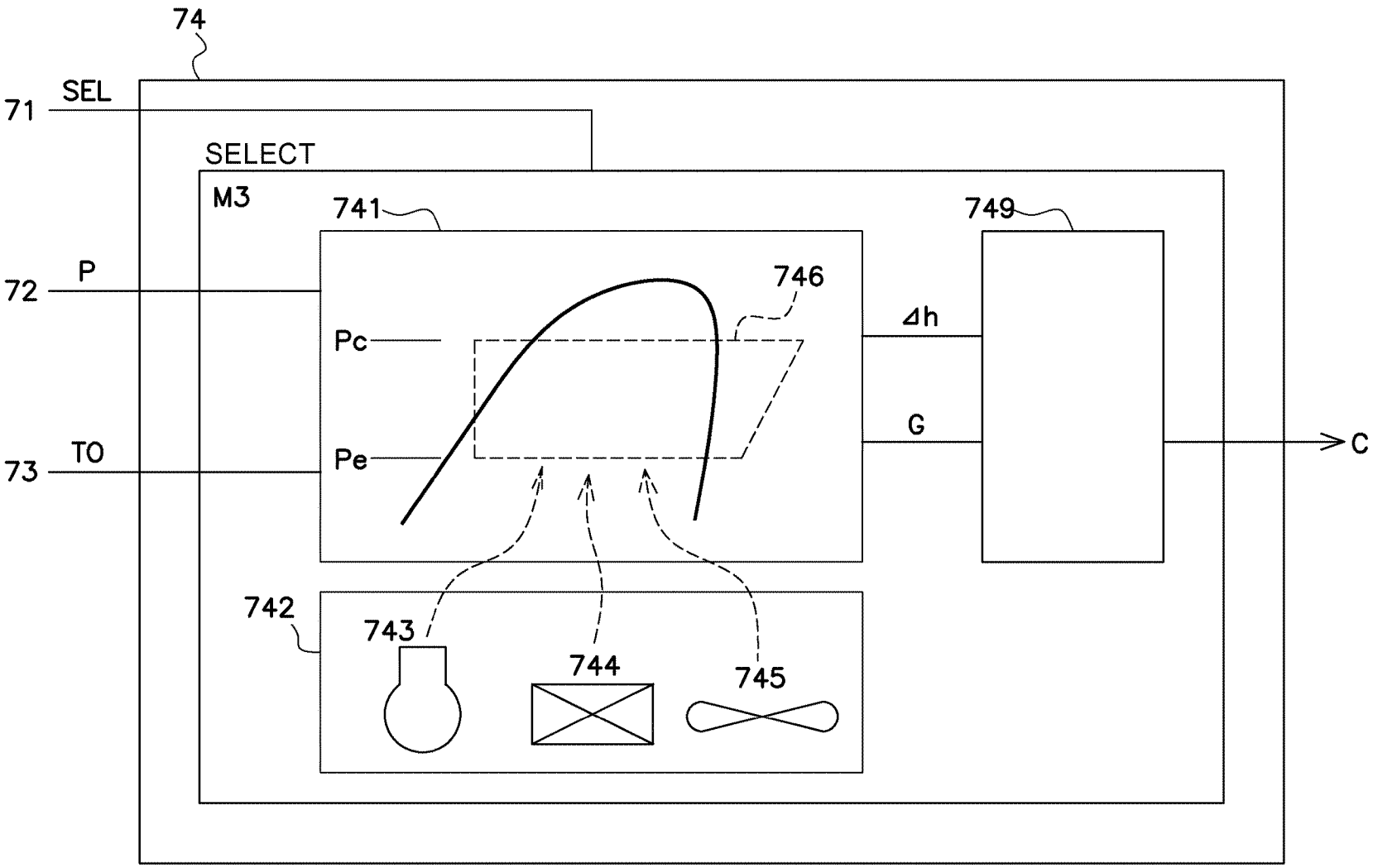
FIG. 6 schematically illustrates Configuration Example 1 of capacity calculation models.

FIG. 6 illustrates the configuration of the capacity calculation models M1 to M8 according to Configuration Example 1.

Each of the capacity calculation models M1 to M8 includes air conditioner performance parameters 742 indicating the performance of the air conditioning apparatus 20 and a final calculation unit 749.

The air conditioner performance parameters 743 may include a compressor performance parameter 753 related to the performance of a compressor of the air conditioning apparatus 20.

The air conditioner performance parameters 743 may also include an outdoor heat exchanger performance parameter 744 related to the performance of the outdoor heat exchanger 42 of the air conditioning apparatus 20.

The air conditioner performance parameters 743 may also include an outdoor fan performance parameter 745 related to the performance of the outdoor fan 43 of the air conditioning apparatus 20.

The final calculation unit 749 calculates a capacity C of the air conditioning apparatus 20 for cooling or heating.

(4-1-2) Operation (4-1-2-1) Select Model

On the basis of at least outdoor unit capacity information SEL output from the outdoor unit capacity information receiving unit 71, the capacity calculating unit 74 selects one capacity calculation model from among the plurality of capacity calculation models M1 to M8.

In this selection, the time, season, or the like during which the air conditioning apparatus 20 is in operation may be taken into account. As a result, which of the cooling capacity calculation models M1 to M4 and the heating capacity calculation models M5 to M8 are to be selected is determined.

(4-1-2-2) Input Measurement Values

Power consumption data P output from the power consumption receiving unit 72 and outside air temperature data TO output from the outside air temperature receiving unit 73 are input to the selected capacity calculation model.

(4-1-2-3) Simulate Refrigeration Cycle 746

On the basis of the power consumption data P, the outside air temperature data TO, and the air conditioner performance parameters 742, the capacity calculation models M1 to M6 derive a condensation pressure Pc or a corresponding temperature corresponding thereto or an evaporation pressure Pe or a corresponding temperature corresponding thereto in a refrigeration cycle.

In deriving the condensation pressure Pc of refrigerant or the corresponding temperature corresponding thereto or the evaporation pressure Pe of refrigerant or the corresponding temperature corresponding thereto, the evaporation pressure Pe of refrigerant or the corresponding temperature corresponding thereto and the condensation pressure Pc of refrigerant or the corresponding temperature corresponding thereto are set. Specifically, the setting is performed in the following procedure.

(Case in which Selected Model is any of Cooling Capacity Calculation Models M1 to M4)

(i) In the refrigeration cycle 746 to be simulated, the evaporation pressure Pe of refrigerant or the corresponding temperature corresponding thereto is set to a predetermined constant. Instead of the evaporation pressure Pe, an evaporating temperature may be set to the predetermined constant.

(ii) In deriving the condensation pressure Pc of refrigerant or the corresponding temperature corresponding thereto, the condensation pressure Pc of refrigerant or the corresponding temperature corresponding thereto is acquired through calculation.

In the calculation for acquiring the condensation pressure Pc of refrigerant or the corresponding temperature corresponding thereto, an outside air heat exchange amount and a refrigerant heat exchange amount may be calculated. Here, "outside air heat exchange amount" indicates heat quantity that the outside air receives in the outdoor heat exchanger, and "refrigerant heat exchange amount" indicates heat quantity that refrigerant loses in the outdoor heat exchanger. The outside air heat exchange amount is calculated based on at least the outside air temperature data TO, and is a function of the condensation pressure Pc or the corresponding temperature corresponding thereto. The refrigerant heat exchange amount is calculated based on at least the power consumption data P and is a function of the condensation pressure Pc or the corresponding temperature corresponding thereto. By iterative calculation using the condensation pressure Pc or the corresponding temperature corresponding thereto as a variable, the condensation pressure Pc or the corresponding temperature corresponding thereto at which the outside air heat exchange amount and the refrigerant heat exchange amount are equal to each other is acquired.

(Case in which Selected Model is any of Heating Capacity Calculation Models M5 to M8)

(i) In deriving the evaporation pressure Pe of refrigerant or the corresponding temperature corresponding thereto, the condensation pressure Pc of refrigerant or the corresponding temperature corresponding thereto is set to a predetermined constant.

(ii) In deriving the evaporation pressure Pe of refrigerant or the corresponding temperature corresponding thereto, the evaporation pressure Pe of refrigerant or the corresponding temperature corresponding thereto is acquired through calculation.

The calculation procedure is performed by the calculation of the outside air heat exchange amount and the refrigerant heat exchange amount as in the case of the cooling capacity calculation models M1 to M4. However, in a case of heating, the outside air heat exchange amount indicates heat quantity that outside air loses in the outdoor heat exchanger, and the refrigerant heat exchange amount indicates heat quantity that refrigerant receives in the outdoor heat exchanger.

(For All Capacity Calculation Models M1 to M8)

The degree of subcooling and the degree of superheating may be presumed to be a predetermined constant.

(4-1-2-4) Acquire Intermediate Calculation Values

The selected capacity calculation model obtains, as intermediate calculation values, a refrigerant circulation amount G and the refrigeration cycle 746 that are obtained based on the air conditioner performance parameters 742 and the power consumption P by using the set evaporation pressure Pe of refrigerant or the corresponding temperature corresponding thereto or the set the condensation pressure Pc of refrigerant or the corresponding temperature corresponding thereto and the derived condensation pressure Pc of refrigerant or the corresponding temperature corresponding thereto or the derived evaporation pressure Pe of refrigerant or the corresponding temperature corresponding thereto.

(4-1-2-5) Calculate Capacity C

On the basis of the intermediate calculation values, the final calculation unit 749 calculates the capacity C of the air conditioning apparatus 20.

(4-2) Configuration Example 2

(4-2-1) Detailed Configuration

Figure 7:
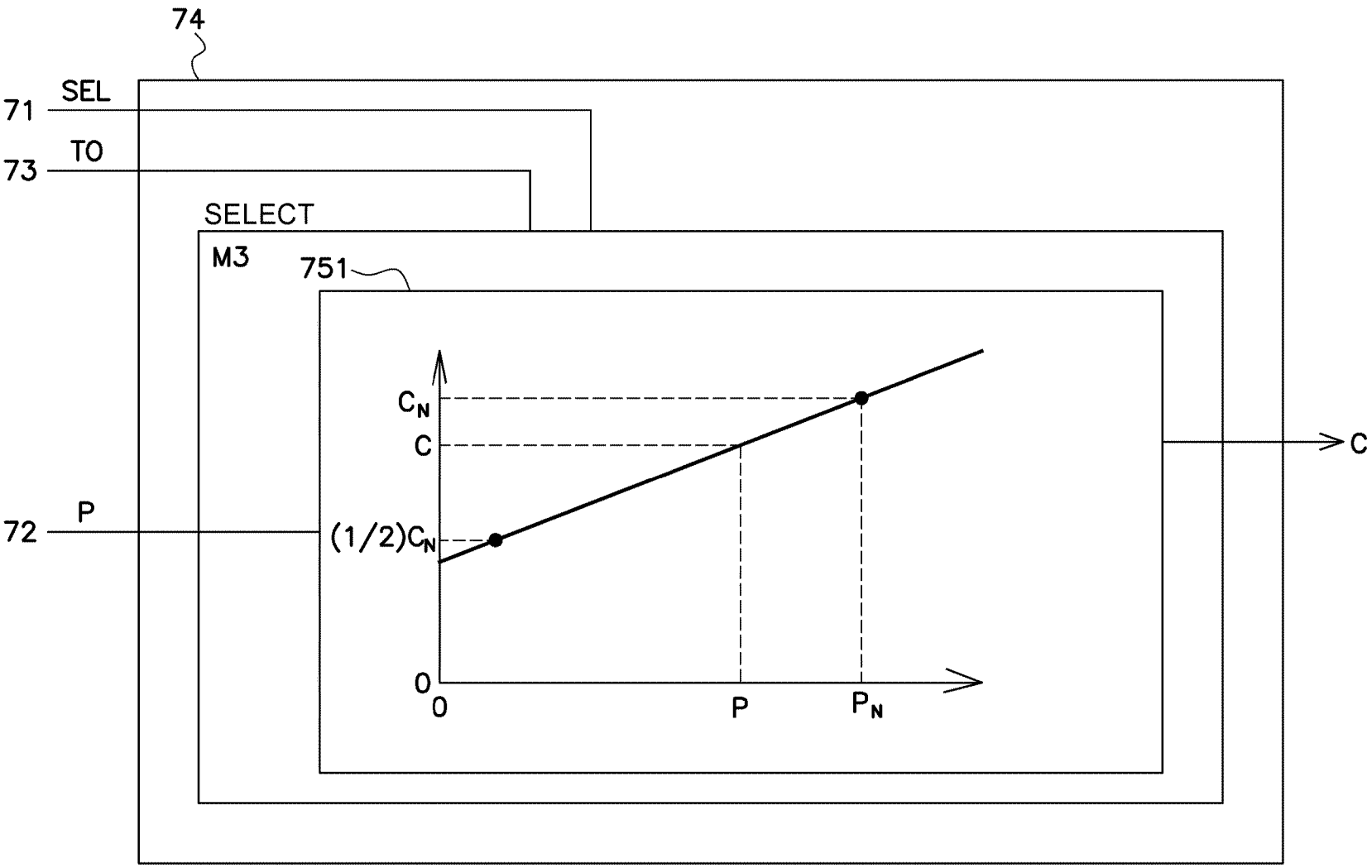
FIG. 7 schematically illustrates Configuration Example 2 of capacity calculation models.

FIG. 7 illustrates the configuration of the capacity calculation models M1 to M8 according to Configuration Example 2.

Each of the capacity calculation models M1 to M8 includes a characteristic formula 751. The characteristic formula is a calculation formula used to reproduce behavior of a certain air conditioning apparatus.

The characteristic formula may express a relationship between the power consumption data P and the capacity C. For example, the characteristic formula may express the capacity C in the form of a linear function of the power consumption data P. The characteristic formula may include rated power consumption PN, a rated capacity CN, a half value (½) of the rated capacity CN, and the like.

(4-2-2) Operation (4-2-2-1) Input Measurement Values

The power consumption data P output from the power consumption receiving unit 72 and the outside air temperature data TO output from the outside air temperature receiving unit 73 are input to the capacity calculating unit 74.

(4-2-2-2) Select Model

On the basis of at least the outdoor unit capacity information SEL and the outside air temperature data TO, the capacity calculating unit 74 selects one capacity calculation model from among the plurality of capacity calculation models M1 to M8.

In this selection, the time, season, or the like during which the air conditioning apparatus 20 is in operation may be taken into account. As a result, which of the cooling capacity calculation models M1 to M4 and the heating capacity calculation models M5 to M8 are to be selected is determined.

(4-2-2-3) Calculate Capacity C

On the basis of the power consumption data P, the final calculation unit 749 calculates the capacity C of the air conditioning apparatus 20.

(4-3) Configuration Example 3

(4-3-1) Detailed Configuration

Figure 8:
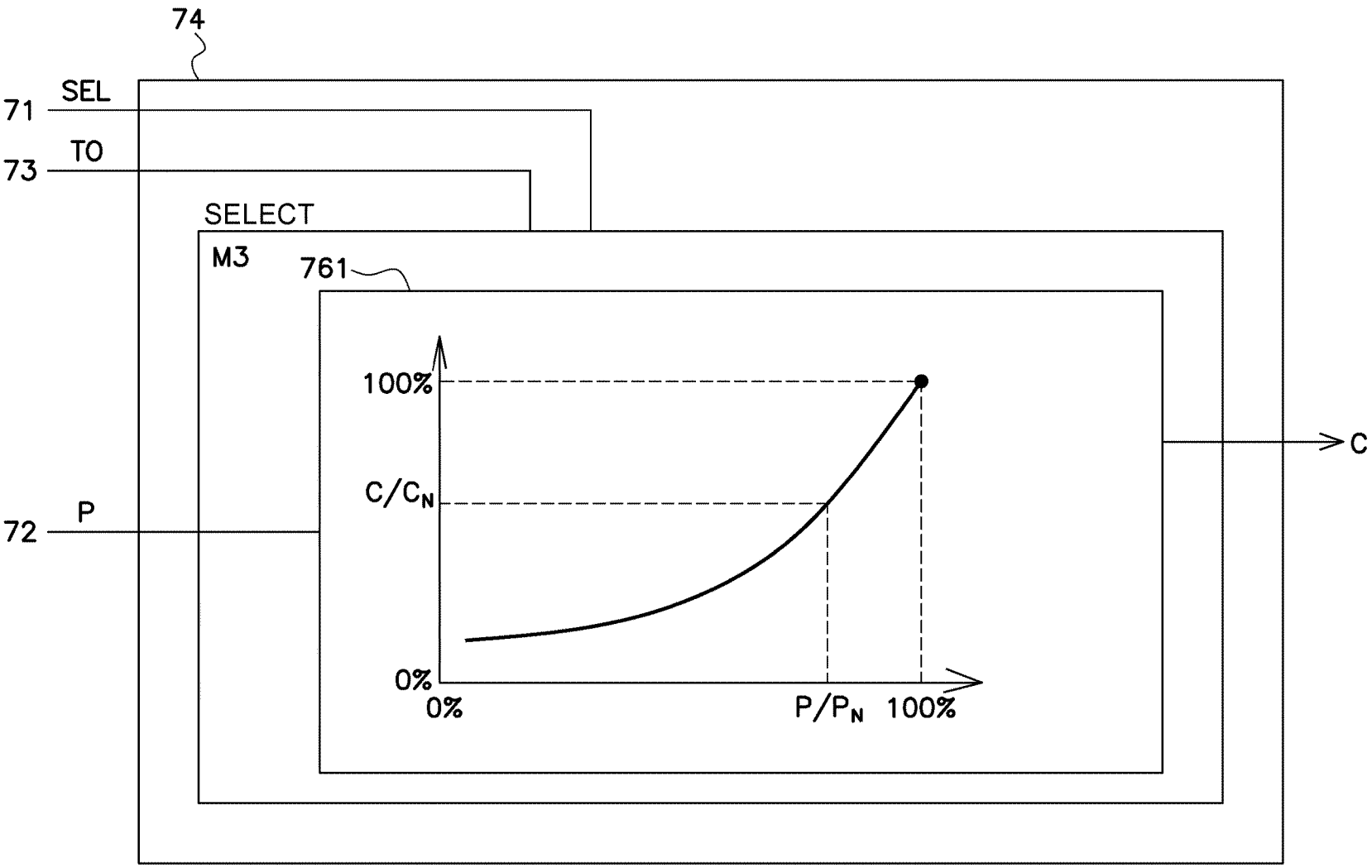
FIG. 8 schematically illustrates Configuration Example 3 of capacity calculation models.

FIG. 8 illustrates the configuration of the capacity calculation models M1 to M8 according to Configuration Example 3.

Each of the capacity calculation models M1 to M8 includes a characteristic formula 761. The characteristic formula is a calculation formula used to reproduce behavior of a certain air conditioning apparatus.

The characteristic formula may express the relationship between the power consumption data P and the capacity C. For example, the characteristic formula may express a ratio C/CN of the capacity C to the rated capacity CN in the form of a function of a ratio P/PN of the power consumption data P to the rated power consumption PN.

(4-3-2) Operation (4-3-2-1) Input Measurement Values

The power consumption data P output from the power consumption receiving unit 72 and the outside air temperature data TO output from the outside air temperature receiving unit 73 are input to the capacity calculating unit 74.

(4-3-2-2) Select Model

On the basis of at least the outdoor unit capacity information SEL and the outside air temperature data TO, the capacity calculating unit 74 selects one capacity calculation model from among the plurality of capacity calculation models M1 to M8.

In this selection, the time, season, or the like during which the air conditioning apparatus 20 is in operation may be taken into account. As a result, which of the cooling capacity calculation models M1 to M4 and the heating capacity calculation models M5 to M8 are to be selected is determined.

(4-3-2-3) Calculate Capacity C

On the basis of the power consumption data P, the final calculation unit 749 calculates the capacity C of the air conditioning apparatus 20.

(4-4) Configuration Example 4

As described above, in the configuration in Configuration Examples 1 to 3, the capacity calculation models M1 to M8 may include an input and output relationship formula in the form of a multidimensional table without performing calculation.

(4-5) Specific Examples (4-5-1)

Each of the capacity calculation models M1 to M8 includes the air conditioner performance parameters 742 indicating the performance of the air conditioning apparatus.

Each of the capacity calculation models M1 to M8 is configured to derive a condensation pressure or a corresponding temperature corresponding thereto or an evaporation pressure or a corresponding temperature corresponding thereto based on the power consumption data P, the outside air temperature data TO, and the air conditioner performance parameters 742, and configured to calculate the calculation value based on the derived condensation pressure or the corresponding temperature corresponding thereto or the derived evaporation pressure or the corresponding temperature corresponding thereto.

At least one of the evaporation pressure Pe of refrigerant or the corresponding temperature corresponding thereto and the condensation pressure Pc of refrigerant or the corresponding temperature corresponding thereto in deriving of the condensation pressure or the corresponding temperature corresponding thereto or the evaporation pressure or the corresponding temperature corresponding thereto is determined as a constant.

Effects of this configuration include that only a small amount of data, which is two types of the power consumption data P and the outside air temperature data TO, may be measured by using the sensors.

(4-5-2)

The air conditioning apparatus 20 includes the compressor and the outdoor heat exchanger 42.

The air conditioner performance parameters 742 include at least one of the compressor performance parameter 753 related to the performance of the compressor, and the outdoor heat exchanger performance parameter 744 related to the performance of the outdoor heat exchanger 42.

Effects of this configuration include that the calculation accuracy of the capacity C is increased since the calculation of the capacity C can reflect the behavior of the compressor or the outdoor heat exchanger 42 mounted on the outdoor unit 40.

(4-5-3)

Each of the capacity calculation models M1 to M8 includes the characteristic formula 751 or the characteristic formula 761 that expresses a relationship between the power consumption P and the capacity C.

Effects of this configuration include that the configuration of the capacity calculation models M1 to M8 is comparatively easy.

(5) Procedure of Capacity Presentation

First, the operator checks the air conditioning apparatus 20, which is existing equipment. The operator arrives at the building B and checks the indoor units 21 to 24, the outdoor unit 40, the connection pipes 31 and 32, and the like.

Subsequently, the operator attaches the power sensor 61 to the outdoor unit power source line 41.

Subsequently, the operator attaches the temperature sensor 62 near the outdoor unit 40.

Subsequently, the operator inputs the following values by using the operation terminal 63.

The outdoor unit capacity information (e.g., the rated capacity of the outdoor unit)

The information related to a pressure loss of refrigerant in the connection pipes 31 and 32

The information related to a rated output of the outdoor fan 43

Subsequently, the operator starts measurement. The power sensor 61 and the temperature sensor 62 keep transmitting measurement value data to the server 100 for a measurement period (e.g., one year).

Subsequently, data analysis is performed. First, based on the outdoor unit capacity information, the capacity calculating unit 74 of the calculation unit 70 selects one (e.g., the capacity calculation model M3) of the plurality of capacity calculation models M1 to M8. Then, to the selected capacity calculation model M3, data of the power consumption and the outside air temperature acquired for the measurement period is input. The capacity calculation model M3 outputs data of the capacity of the air conditioning apparatus 20 that has been needed for the measurement period. Thus, the capacity calculating unit 74 outputs the calculation value of the needed capacity.

Subsequently, the calculation value of the capacity is corrected. The correction unit 75 corrects the calculation value of the capacity based on the following information and outputs the corrected calculation value.

The information related to a pressure loss of refrigerant in the connection pipes 31 and 32

The information related to a rated output of the outdoor fan 43

Thus, the correction unit 75 presents the corrected calculation value of the capacity.

Subsequently, a proposal for updating the air conditioning apparatus 20 is made. On the basis of the maximum value of the calculation value or the corrected calculation value of the capacity, the proposal creating unit 76 creates a proposal of a unit-to-be-newly-introduced that is to replace at least one of the indoor units 21 to 24 and the outdoor unit 40.

(6) Characteristics (6-1)

On the basis of the outdoor unit capacity information, the power consumption, and the outside air temperature, the calculation value of the air conditioning capacity is obtained. Thus, the calculation of the capacity does not need many types of data to be acquired. That is, efforts necessary for the operator to measures the capacity are reduced. In particular, the temperature sensor 62 does not perform measurement related to the blown-out air discharged from the outdoor unit 40 after heat exchange. Furthermore, since the large number of sensors are included in the system for measuring the capacity, the cost of the system for measuring the capacity is low.

(6-2)

The capacity calculating unit 74 selects one capacity calculation model based on the outdoor unit capacity information. Thus, a capacity calculation model appropriate for simulating the capacity of the outdoor unit is used.

(6-3)

On the basis of the information related to a pressure loss of refrigerant in the connection pipes and the information related to a rated output of the outdoor fan, the correction unit 75 corrects the calculation value to obtain a corrected calculation value. This increases the accuracy of the necessary capacity.

(7) Modifications (7-1) Modification 1A

In the above embodiment, the temperature sensor 62 and the outside air temperature receiving unit 73 acquire the outside air temperature. Instead of this, a temperature/humidity sensor 62' and an outside air temperature/humidity receiving unit 73' may be provided and may acquire an outside air temperature and an outside air humidity. In this case, based on the outdoor unit capacity information, the power consumption, the outside air temperature, and the outside air humidity, the capacity calculating unit 74 obtains the calculation value of the capacity of the air conditioning apparatus 20.

According to this configuration, the outside air humidity is also used in addition to the other parameters to obtain the calculation value of the capacity. Thus, the calculation value with higher accuracy is obtained.

(7-2) Modification 1B

Figure 3:
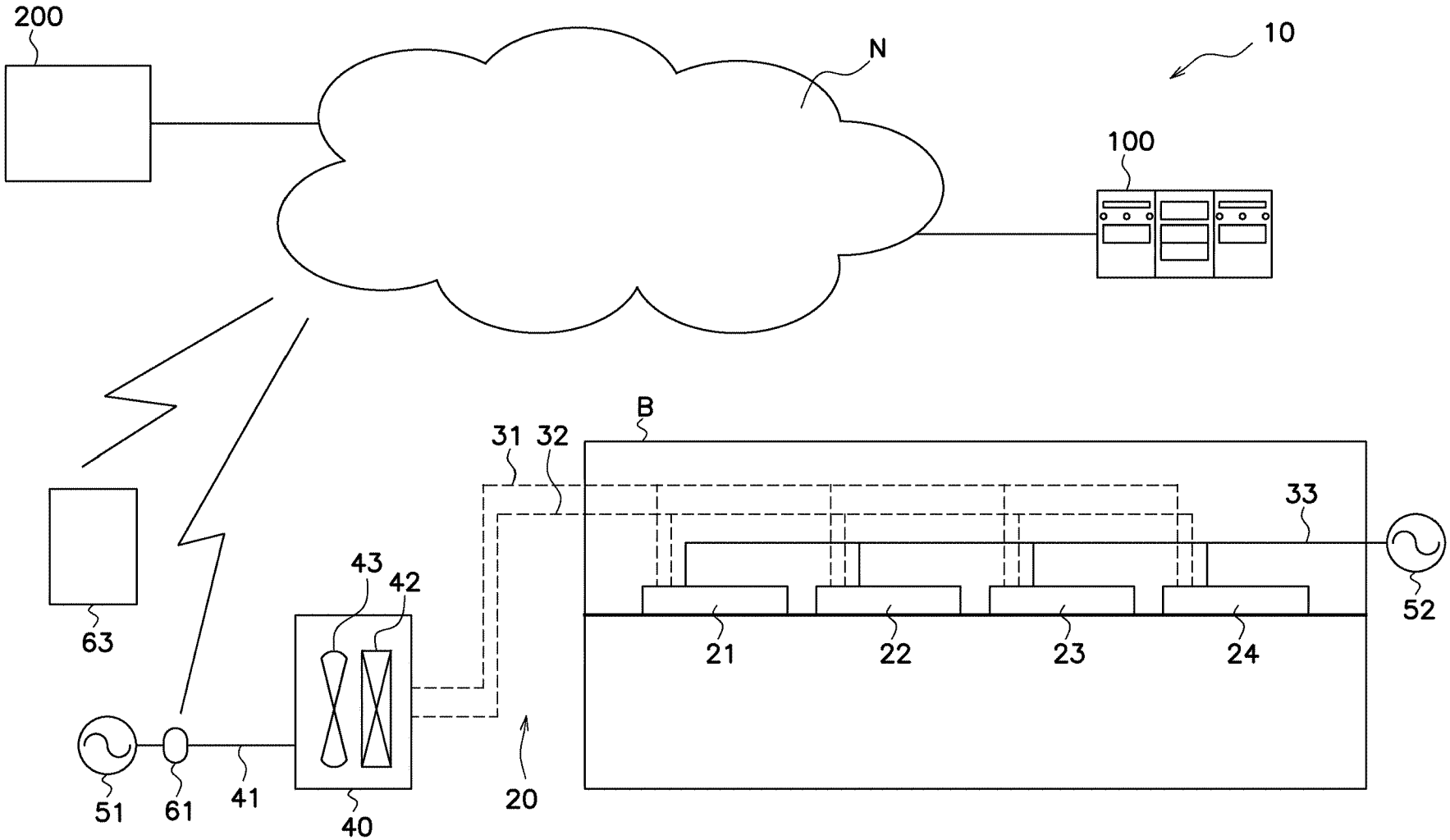
FIG. 3 schematically illustrates the air conditioning capacity presenting system 10 according to Modification 1B of the first embodiment.

In the above embodiment, data of the outside air temperature is acquired by the temperature sensor 62. Instead of this, as illustrated in FIG. 3, data of the outside air temperature may be acquired from a weather data bank 200 connected to the network N.

Second Embodiment (1) Overall Configuration

Figure 4:
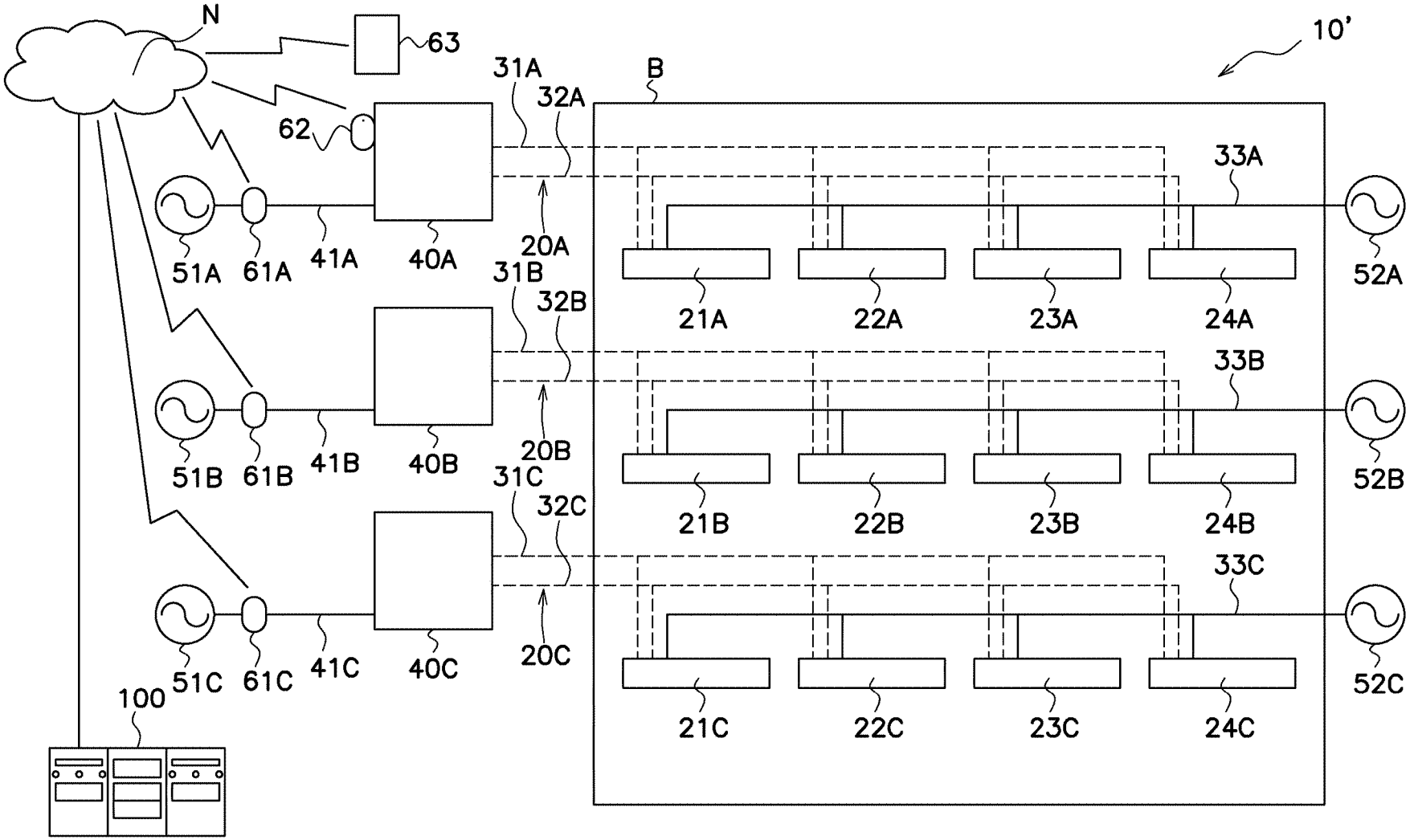
FIG. 4 schematically illustrates an air conditioning capacity presenting system 10' according to a second embodiment.

FIG. 4 illustrates an overall configuration of an air conditioning capacity presenting system 10'. The air conditioning capacity presenting system 10' differs from the first embodiment in including a plurality of systems of air conditioning apparatuses. The air conditioning capacity presenting system 10' includes a first system 20A, a second system 20B, and a third system 20C of air conditioning apparatuses. The air conditioning capacity presenting system 10' further includes power sensors 61A to 61C, the temperature sensor 62, the operation terminal 63, the network N, and the server 100.

(2) Detailed Configuration (2-1) Air Conditioning Apparatuses

The air conditioning apparatuses include the first system 20A, the second system 20B, and the third system 20C. The first system 20A includes indoor units 21A to 24A, an outdoor unit 40A, and connection pipes 31A and 32A. The second system 20B includes indoor units 21B to 24B, an outdoor unit 40B, and connection pipes 31B and 32B. The third system 20C includes indoor units 21C to 24C, an outdoor unit 40C, and connection pipes 31C and 32C.

(2-2) Power Sensors 61A to 61C

The power sensor 61A measures power consumption of the outdoor unit 40A that belongs to the first system 20A. The power sensor 61B measures power consumption of the outdoor unit 40B that belongs to the second system 20B. The power sensor 61C measures power consumption of the outdoor unit 40C that belong to the third system 20C.

A piece of identification information is allocated to each of the power sensors 61A to 61C.

(2-3) Temperature Sensor 62

The temperature sensor 62 acquires the outside air temperature. For example, the temperature sensor 62 is attached near the outdoor unit 40A.

(2-4) Operation Terminal 63

The operation terminal 63 performs the processing described in the first embodiment.

In addition, the operation terminal 63 accepts input of association between the power sensors 61A to 61C and the first system 20A to the third system 20C. As illustrated in FIG. 5, the operation terminal 63 displays the pieces of identification information of the power sensors 61A to 61C and also accepts input of association between the pieces of identification information and the systems from the operator.

(2-5) Others

Other elements are substantially the same as those in the first embodiment.

(3) Capacity Presentations

The capacity calculating unit 74 outputs the calculation value of the necessary capacity. As necessary, the calculation value of the capacity is corrected. Thus, the correction unit 75 presents the corrected calculation value of the capacity that has been necessary for each system.

Subsequently, a proposal for updating the air conditioning apparatus 20 is made. On the basis of the maximum value of the calculation value or the corrected calculation value of the capacity, the proposal creating unit 76 creates a proposal of a unit-to-be-newly-introduced that is to replace at least part of the outdoor units and the indoor units for the plurality of systems.

(4) Characteristics (4-1)

The power consumption is calculated for each system. However, in the plurality of systems, the temperature sensor 62 is shared. Thus, the number of temperature sensors 62 to be installed is small.

(4-2)

The operation terminal 63 accepts input of association between the pieces of identification information of the power sensors 61A to 61C and the systems. Thus, initial setting for performing measurement by using the power sensors 61A to 61C is easy.

(4-3)

The proposal creating unit 76 of the calculation unit 70 creates a proposal of the unit-to-be-newly-introduced that is to replace at least part of the outdoor units and the indoor units for each of the plurality of systems.

(5) Modifications

Each of the modifications in the first embodiment is applicable to the second embodiment.

Although the embodiments of the present disclosure have been described above, it should be understood that various changes can be made on the forms and details without departing from the spirit and scope of the present disclosure described in the scope of claims.

What is claimed is:

1. An air conditioning capacity presenting system that presents a capacity of an air conditioning apparatus including at least one outdoor unit, at least one indoor unit, and a connection pipe that connects the outdoor unit and the indoor unit, the air conditioning capacity presenting system comprising:

a first acquisition unit configured to acquire outdoor unit capacity information, which is a rated capacity of the outdoor unit or information related to the rated capacity, the first acquisition unit including an operation terminal;

a measurement unit configured to measure power consumption of the outdoor unit, the measurement unit including a first sensor;

a second acquisition unit configured to acquire an outside air temperature, which is a temperature of air around the outdoor unit, the second acquisition unit including a second sensor; and a capacity calculating unit configured to obtain a calculation value of the capacity of the air conditioning apparatus based on the outdoor unit capacity information, the power consumption, and the outside air temperature, the capacity calculating unit including a plurality of capacity calculation models.

2. The air conditioning capacity presenting system according to claim 1, wherein the capacity calculating unit is further configured to select one capacity calculation model from the plurality of capacity calculation models based on the outdoor unit capacity information.

3. The air conditioning capacity presenting system according to claim 2, wherein each of the capacity calculation models includes an air conditioner performance parameter indicating performance of the air conditioning apparatus, each of the capacity calculation models is configured to derive a condensation pressure or a corresponding temperature corresponding thereto, or an evaporation pressure (Pe) or a corresponding temperature corresponding thereto, in a refrigeration cycle based on the power consumption, the outside air temperature, and the air conditioner performance parameter, and to calculate the calculation value based on the derived condensation pressure or the corresponding temperature corresponding thereto, or the derived evaporation pressure or the corresponding temperature corresponding thereto, and at least one of the evaporation pressure of the refrigerant or the corresponding temperature corresponding thereto, and the condensation pressure of the refrigerant or the corresponding temperature corresponding thereto in the refrigeration cycle is determined as a constant.

4. The air conditioning capacity presenting system according to claim 2, wherein each of the capacity calculation models includes a characteristic formula that expresses a relationship between the power consumption and the capacity.

5. The air conditioning capacity presenting system according to claim 2, wherein the plurality of capacity calculation models include a plurality of cooling capacity calculation models and a plurality of heating capacity calculation models.

6. The air conditioning capacity presenting system according to claim 2, further comprising:

a correction unit configured to correct the calculation value to obtain a corrected calculation value.

7. The air conditioning capacity presenting system according to claim 2, wherein the second acquisition unit is further configured to acquire an outside air humidity, which is a humidity of the air around the outdoor unit, and the capacity calculating unit is configured to obtain the calculation value of the capacity of the air conditioning apparatus based on the outdoor unit capacity information, the power consumption, the outside air temperature, and the outside air humidity.

8. The air conditioning capacity presenting system according to claim 2, wherein the second acquisition unit is configured to not perform measurement related to blown-out air discharged from the outdoor unit after heat exchange.

9. The air conditioning capacity presenting system according to claim 1, further comprising:

a correction unit configured to correct the calculation value to obtain a corrected calculation value.

10. The air conditioning capacity presenting system according to claim 9, wherein the correction unit is configured to correct the calculation value based on information related to a pressure loss of refrigerant in the connection pipe.

11. The air conditioning capacity presenting system according to claim 9, wherein the outdoor unit includes an outdoor fan, and the correction unit is configured to correct the calculation value based on information related to a rated output of the outdoor fan.

12. The air conditioning capacity presenting system according to claim 9, further comprising:

a proposal creating unit configured to create a proposal of a unit-to-be-newly-introduced that is to replace at least part of the outdoor unit and the indoor unit based on a maximum value of the calculation value or the corrected calculation value within a predetermined period.

13. The air conditioning capacity presenting system according to claim 12, wherein the air conditioning apparatus includes plurality of systems, each of the plurality of systems includes at least one outdoor unit, and the measurement unit is configured to measure the power consumption of each of the plurality of systems.

14. The air conditioning capacity presenting system according to claim 13, wherein the measurement unit includes a plurality of first sensors that measure the power consumption of the plurality of systems, respectively, the operation terminal being configured to display pieces of identification information of the first sensors, and the operation terminal being configured to accept input of association between the pieces of identification information and the systems.

15. The air conditioning capacity presenting system according to claim 13, wherein the proposal creating unit is configured to create the proposal of the unit-to-be-newly-introduced that is to replace at least part of the outdoor unit and the indoor unit for each of the plurality of systems.

16. The air conditioning capacity presenting system according to claim 9, wherein the second acquisition unit is further configured to acquire an outside air humidity, which is a humidity of the air around the outdoor unit, and the capacity calculating unit is configured to obtain the calculation value of the capacity of the air conditioning apparatus based on the outdoor unit capacity information, the power consumption, the outside air temperature, and the outside air humidity.

17. The air conditioning capacity presenting system according to claim 9, wherein the second acquisition unit is configured to not perform measurement related to blown-out air discharged from the outdoor unit after heat exchange.

18. The air conditioning capacity presenting system according to claim 1, wherein the second acquisition unit is further configured to acquire an outside air humidity, which is a humidity of the air around the outdoor unit, and the capacity calculating unit is configured to obtain the calculation value of the capacity of the air conditioning apparatus based on the outdoor unit capacity information, the power consumption, the outside air temperature, and the outside air humidity.

19. The air conditioning capacity presenting system according to claim 1, wherein the second acquisition unit is configured to not perform measurement related to blown-out air discharged from the outdoor unit after heat exchange.

20. A method of measuring a capacity of an air conditioning apparatus including at least one outdoor unit and at least one indoor unit, the method comprising:

acquiring outdoor unit capacity information, which is a rated capacity of the outdoor unit or information related to the rated capacity;

measuring power consumption of the outdoor unit;

acquiring an outside air temperature, which is a temperature of air around the outdoor unit; and outputting a calculation value of the capacity of the air conditioning apparatus based on the outdoor unit capacity information, the power consumption, and the outside air temperature.

* * * * *